US009468961B2

(12) United States Patent
Davi

(10) Patent No.: US 9,468,961 B2
(45) Date of Patent: Oct. 18, 2016

(54) APPARATUS AND METHOD FOR THE ELECTROHYDRAULIC CONTROL OF PARALLELISM IN A BENDING MACHINE FOR WORKING METAL PRODUCTS

(75) Inventor: Orazio Maria Davi, Cesena (IT)

(73) Assignee: PROMAU S.R.L., Cesena (IT)

( * ) Notice: Subject to any disclaimer, the term of this patent is extended or adjusted under 35 U.S.C. 154(b) by 1120 days.

(21) Appl. No.: 13/557,513

(22) Filed: Jul. 25, 2012

(65) Prior Publication Data

US 2013/0025335 A1 Jan. 31, 2013

(30) Foreign Application Priority Data

Jul. 27, 2011 (IT) ..... MI2011A1408

(51) Int. Cl.
*B21D 5/14* (2006.01)
*F15B 11/22* (2006.01)

(52) U.S. Cl.
CPC ..... *B21D 5/14* (2013.01); *F15B 11/22* (2013.01); *F15B 2211/20576* (2013.01); *F15B 2211/41563* (2013.01); *F15B 2211/426* (2013.01); *F15B 2211/45* (2013.01); *F15B 2211/6336* (2013.01); *F15B 2211/7107* (2013.01); *F15B 2211/7142* (2013.01); *F15B 2211/7656* (2013.01); *F15B 2211/782* (2013.01)

(58) Field of Classification Search
CPC ..... B21D 5/14; F15B 2211/782; F15B 2211/41563; F15B 2211/7656; F15B 2211/20576; F15B 11/22
See application file for complete search history.

(56) References Cited

U.S. PATENT DOCUMENTS

| | | | | |
|---|---|---|---|---|
| 5,187,959 A * | 2/1993 | Davi | B21D 5/14 | 72/10.6 |
| 5,218,850 A * | 6/1993 | Davi | B21D 5/14 | 72/171 |
| 5,890,386 A * | 4/1999 | Davi | B21D 5/14 | 72/13.4 |
| 6,044,675 A * | 4/2000 | Davi | B21D 5/14 | 72/173 |
| 6,240,758 B1 * | 6/2001 | Nagakura | B21D 5/02 | 72/16.9 |
| 8,024,926 B2 * | 9/2011 | Cheong | F15B 11/17 | 60/329 |

FOREIGN PATENT DOCUMENTS

| | | |
|---|---|---|
| EP | 0 103 727 A1 | 3/1984 |
| GB | 1 083 138 | 9/1967 |
| JP | 59-225821 | 12/1984 |

* cited by examiner

*Primary Examiner* — Moshe Wilensky
*Assistant Examiner* — Pradeep C Battula
(74) *Attorney, Agent, or Firm* — Silvia Salvadori, P.C.; Silvia Salvadori

(57) ABSTRACT

An apparatus for the electrohydraulic control of the parallelism of a roller in a bending machine for working metal pieces, has a first and second pumps for supplying with an operating fluid a first and second actuators, position transducers and a first and second proportional valves to adjust the flow of the operating fluid into the first and second actuators according to signals of the position transducers.

5 Claims, 3 Drawing Sheets

APPARATUS AND METHOD FOR THE ELECTROHYDRAULIC CONTROL OF PARALLELISM IN A BENDING MACHINE FOR WORKING METAL PRODUCTS

This application claims priority to and the benefit of Italian Application No. MI2011A001408 filed on Jul. 27, 2011, the content of which is incorporated herein by reference in its entirety.

DESCRIPTION OF THE INVENTION

The present invention relates to the field of bending machines for bending sheet metals or metal plates, section bars and the like, and more in particular it relates to an apparatus and to a method for controlling the parallelism of one or more rollers of a bending machine with respect to a reference axis.

The invention further relates to a bending machine with two or more bending machine rollers for bending metal products such sheet metals, metal plates, section bars or the like, provided with a control apparatus as mentioned above.

Apparatuses are known for controlling the parallelism of the rollers of machines for bending a sheet metal such as to obtain an end product having a desired shape or with an appropriate radius of curvature. Such apparatuses act, during working of a sheet metal, to maintain the longitudinal axis of a first roller, that is movable, parallel to itself or parallel to the longitudinal axis of a second fixed roller, depending on the type of working operation to be performed.

Among the various apparatuses in use, with reference to FIG. 3 a control apparatus 100 for a bending machine is known that comprises a hydraulic pump P100 that supplies pressurized oil to a first lifting hydraulic actuator C101 and to a second lifting hydraulic actuator C102, which are connected to opposite ends of a movable roller R100. The first C101 and the second C102 hydraulic actuator act for lifting the movable roller R100, which in this manner moves in relation to a dragging roller with a fixed longitudinal axis. The hydraulic pump P100 sends high-pressure oil to a hydraulic circuit 101 connected in common to the first C101 and to the second C102 lifting hydraulic actuator. In particular, the hydraulic circuit 101 comprises a first portion 102, connected directly to the pump P100, which branches off into a first and second circuit branch, which are connected respectively to the first C101 and to the second C102 lifting hydraulic actuator, and along which a first VD101 and a second VD102 directional valve are respectively provided that are commanded to control the flow direction of the oil. The two circuit branches have respectively a first proportional flow valve VP101 and a second proportional flow valve VP102 placed in series along the respective delivery paths of the high-pressure oil to the first C101 and second C102 hydraulic actuators. There are provided a first T101 and a second T102 position transducer which are arranged to detect the position of a respective end of the movable roller R100. An electronic control unit U100 is provided that is operationally connected to the first T101 and second T102 position transducer, to the first VP101 and second VP102 proportional valve and to the first VD101 and second VD102 directional valve.

At the first circuit portion 102 connected to the pump P100 a maximum valve Vmax is provided that is suitable for sending pressurized oil coming from the pump P100 directly into a tank 103 of the circuit 100 if the pressure of the oil reaches a set maximum safety value.

During operation, the pump P100 circulates the oil that flows freely first through the first VP101 and second VP102 proportional flow valves, and subsequently through the first VD101 and second VD102 directional valves, which in turn send the oil to the first C101 and second C102 hydraulic actuators, which are in turn driven to raise or lower the movable roller R100. The first T101 and the second T102 position transducer send the signals to the control unit U100, which compares, in real time, step by step, the various positions taken by the movable roller R100, which in this manner can be moved parallel to itself.

If one of the two hydraulic actuators, for example the second actuator C102, moves faster than the first actuator C101, the electronic control unit U100, through the detection carried out by the position transducers T101 and T102, drives for closing the second proportional valve VP102 such as to "throttle", i.e. reduce the flowrate of oil to the second actuator C102. The speed at which the second actuator C102 moves is thus reduced proportionally to the throttling to which the second proportional valve VP102 is subjected. In particular, closing the second proportional valve VP102 "throttles" the passage of the oil which finds less resistance in the first proportional valve VP101 and thus flows more into the latter, thus increasing the drive speed of the first hydraulic actuator C101 until the movable roller R100 is repositioned parallel to the second fixed roller. The first VP101 and second VP102 proportional flow valves, during normal operation, are thus normally open but are continuously more or less closed, according to what has been disclosed above, if a condition of non parallelism of the movable roller R100 with respect to the fixed roller occurs. One of the aforesaid proportional valves VP101, VP102, is variably closed according to the amount of the deviation of the movable roller R100 from the parallelism condition.

A drawback of such a known control apparatus is that for ensuring parallelism in the bending machine perfect operation of the electronic componentry is required, in particular of the proportional valves VP101, VP102, which are always at risk in very corrosive and dirty environments such as mechanical shops for processing a sheet metal. Further, in such environments there is often calamine, which is harmful to the electronic componentry, which is also sorely tried by the continuous and violent electric shocks that occur during welding operations of metal workpieces. In the event of a fault or malfunction in the proportional valves VP101, VP102, because it is not longer possible to maintain and ensure the parallelism condition between the movable roller R100 and the fixed roller, the machine would no longer be usable in any way until the fault had been completely eliminated. In such cases, a machine downtime results that is financially damaging because of the drop in productivity.

Another drawback of such an apparatus is that the continuous closing operations of the first VP101 and second VP102 proportional valve in order to ensure the parallelism of the movable roller R100 with respect to the fixed roller, leads frequently to a general pressure increase in the hydraulic circuit 101 that entails intense wear, the generation of a great quantity of heat and an enormous waste of power. Pressure in the hydraulic circuit is thus unnecessarily pushed to high, even maximum levels, not because of the actual work loads, but because of the need to establish parallelism, in particular in the case of loads that are not centered on the movable roller. For example, when one of the two hydraulic actuators moves faster than the other, and, by modulating the opening of the proportional valve associated therewith, it is not possible to slow the actuator in such a manner that it is reached by the other actuator, it is necessary to act on the respective proportional valve in such a manner as to throttle the passage of oil to the point that such a passage is even completely obstructed. This causes a drastic and sudden increase in pressure which reaches the maximum value and this occurs, as said, not in order to cope with a work load but merely in order to restore parallelism.

This causes unnecessary fatigue to the proportional valves, which work incessantly, and to the pump and all the other components of the hydraulic system, which are stressed unnecessarily at high pressures even up to the maximum safety level.

In other words, this pressure increase, which is due to throttling, prevents the bending capacity of the bending machine from being exploited to the full. In other words, correcting the parallelism leads to having continuous overpressure compared with the normal pressure values that are strictly necessary for being able to bend a metal plate. In some processes and/or for products of large dimensions, the aforesaid overpressure is such as to make the maximum valve Vmax intervene very frequently to prevent damage to the bending machine. This prevents the maximum available pressure from being transformed totally into bending action, thus entailing a de facto "waste", i.e. an inefficient use of the pressure.

An object of the invention is to improve known apparatuses for controlling parallelism in bending machines by overcoming the drawbacks mentioned above. In particular, an object of the invention is to supply an apparatus and a control method that even in the event of undesired faults in electronic components in the apparatus enables, in certain work conditions, the parallelism of one or more rollers in a bending machine to be ensured, thus enabling the bending machine to be used continuously and uneconomical machine downtime to be avoided.

A further object is to provide an apparatus and a method that enable the capacities of the bending machine to be exploited fully, i.e. that enable the pressure that is available in a hydraulic circuit of the bending machine to be exploited more efficiently so as to be able to exert greater loads and thus to be able to bend metal workpieces of a greater thickness or in general of greater dimensions.

In a first aspect of the invention an apparatus is provided for the electrohydraulic control of the parallelism of a bending machine as defined in claim 1.

In a second aspect of the invention a method is provided for the electrohydraulic control of the parallelism in a bending machine as defined in claim 7.

Owing to the invention, the aforementioned drawbacks are overcome.

Further features and advantages will become clear from the appended claims and from the description.

The invention can be better understood and implemented with reference to the attached drawings, which illustrate an embodiment thereof by way of non-limiting example, in which:

FIG. 4 shows schematically an apparatus, according to the present invention, for the electrohydraulic control of the parallelism in a bending machine, as shown in FIG. 1 or 2, for working metal pieces, such as sheet metals, section bars and the like.

Figure 2:
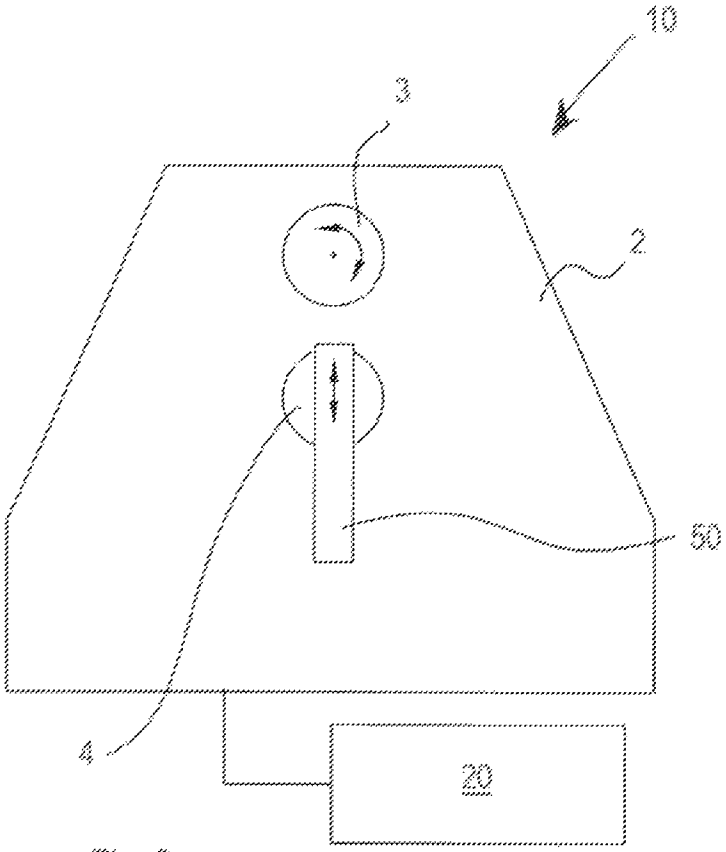
FIGS. 1 and 2 are schematic views respectively of a bending machine with four rollers and of a bending machine with two rollers, for bending metal pieces, in which the control apparatus according to the invention can be provided to control the parallelism of one or more rollers.
Figure 1:
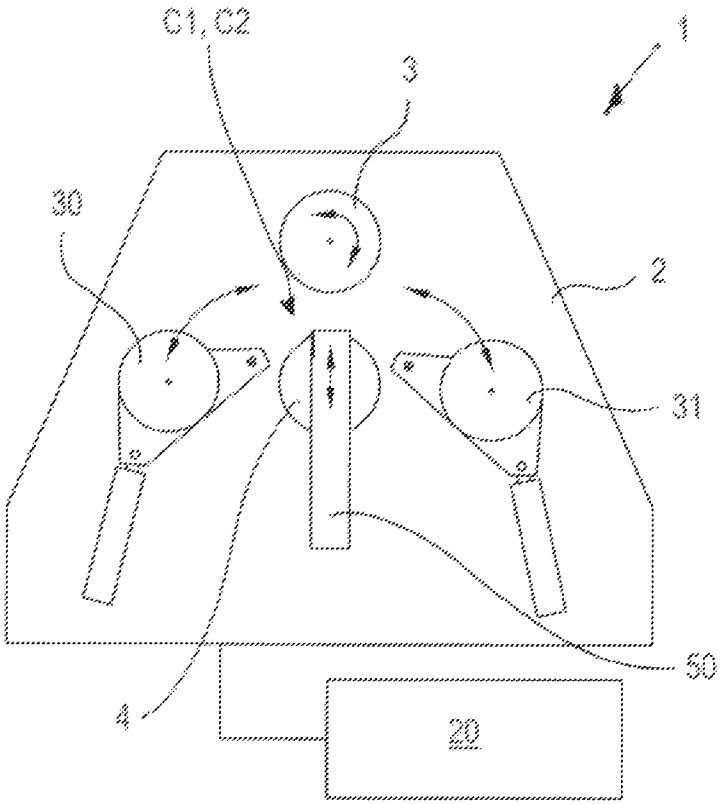
Figure 3:
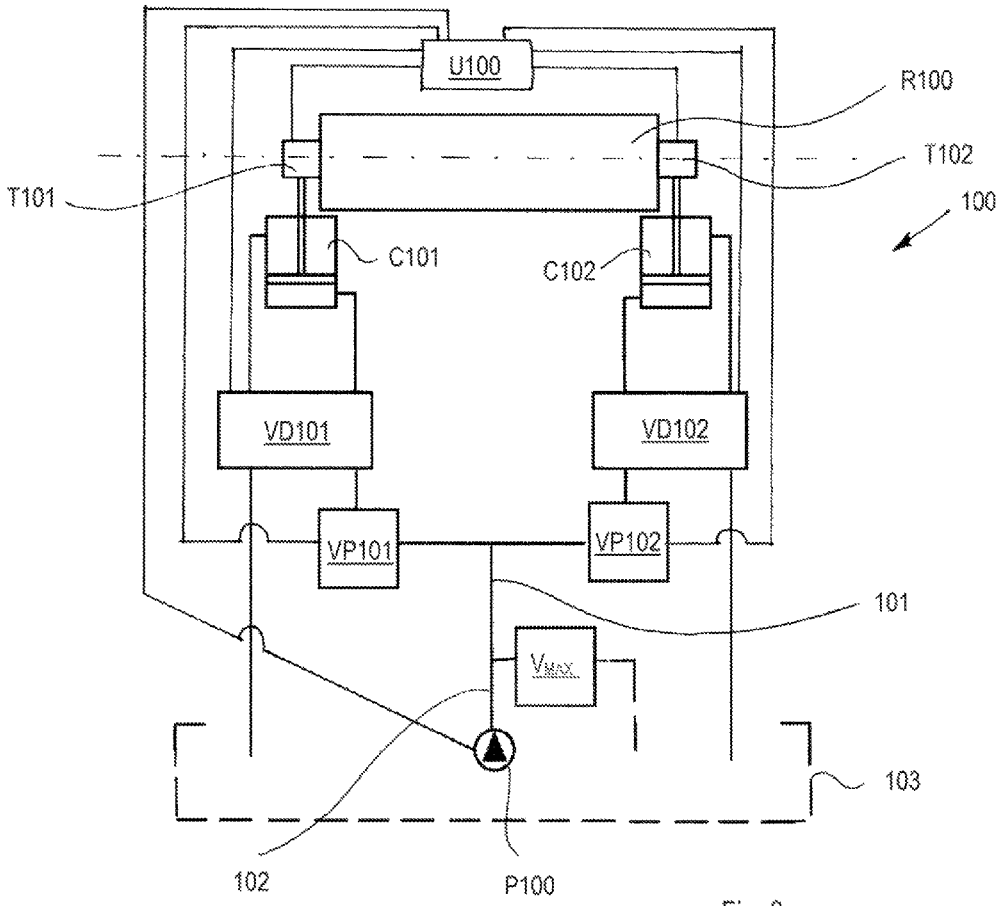
Fig. 3 PRIOR ART
FIG. 3 shows schematically the prior-art control apparatus disclosed above.

With reference to FIGS. 1 and 2, there are respectively shown a bending machine 1 of the four-roller type, and a bending machine 10 of the two-roller type for working metal products, in particular for bending L-shaped sheet metal, metal profiled sections or other similar products.

Both the bending machine 1 and the bending machine 10 each comprise a supporting frame 2 supporting one or more dragging rollers for the advancement of the piece of sheet metal L to be bent that are connected to respective reduction gears. In FIGS. 1 and 2, for the sake of simplicity, there is shown only one dragging roller 3. There is also provided a movable roller 4 for pinching the piece of sheet metal L, the movable roller 4 being configured for being brought near, and moved away from the aforesaid dragging roller 3. The movable roller 4 is supported by hydraulic actuators C1, C2, of the dual-effect type, that are drivable for raising and lowering the movable roller 4. At the two ends of the movable roller 4 respective slides 50 are provided that are arranged for guiding the ascent and descent movement of the movable roller 4.

The dragging roller 3, in a non-limiting manner, can be supported by an overturnable arm that enables a workpiece to be removed once it has been bent. The bending machine 1 is further provided with a first 30 and a second 31 idle roller supported by respective oscillating arms pivoted on side pivots.

The aforesaid bending machines 1 and 10 represent two possible apparatuses in which a control apparatus 20 according to the invention, which will be disclosed below, can be incorporated and which is used to vary the tilt of the or of each movable roller, for example to correct bending defects or to make conical bends, whilst maintaining always control of the parallelism of the roller with respect to the axis thereof or according to a preset axis.

It remains understood that the control apparatus 20 according to the invention—which will be disclosed in detail below—can be applied for controlling parallelism both in bending machines with rollers that are movable along linear guides and vertical or horizontal axes and in bending machines provided with rollers moving along planetary guides or supported by oscillating arms pivoted on side pivots.

In the description that follows that is provided by way of example, for the sake of clarity, a case is disclosed in which the control apparatus 20 is configured for controlling the parallelism of the only movable roller 4, in the bending machine 1 or 10 shown In FIGS. 1 and 2. Obviously, parallelism control can also be applied to several or all the moving rollers of a bending machine, providing several respective control apparatuses 20 or a single control apparatus 20 that is suitably configured for controlling all the aforesaid moving rollers.

Figure 4:
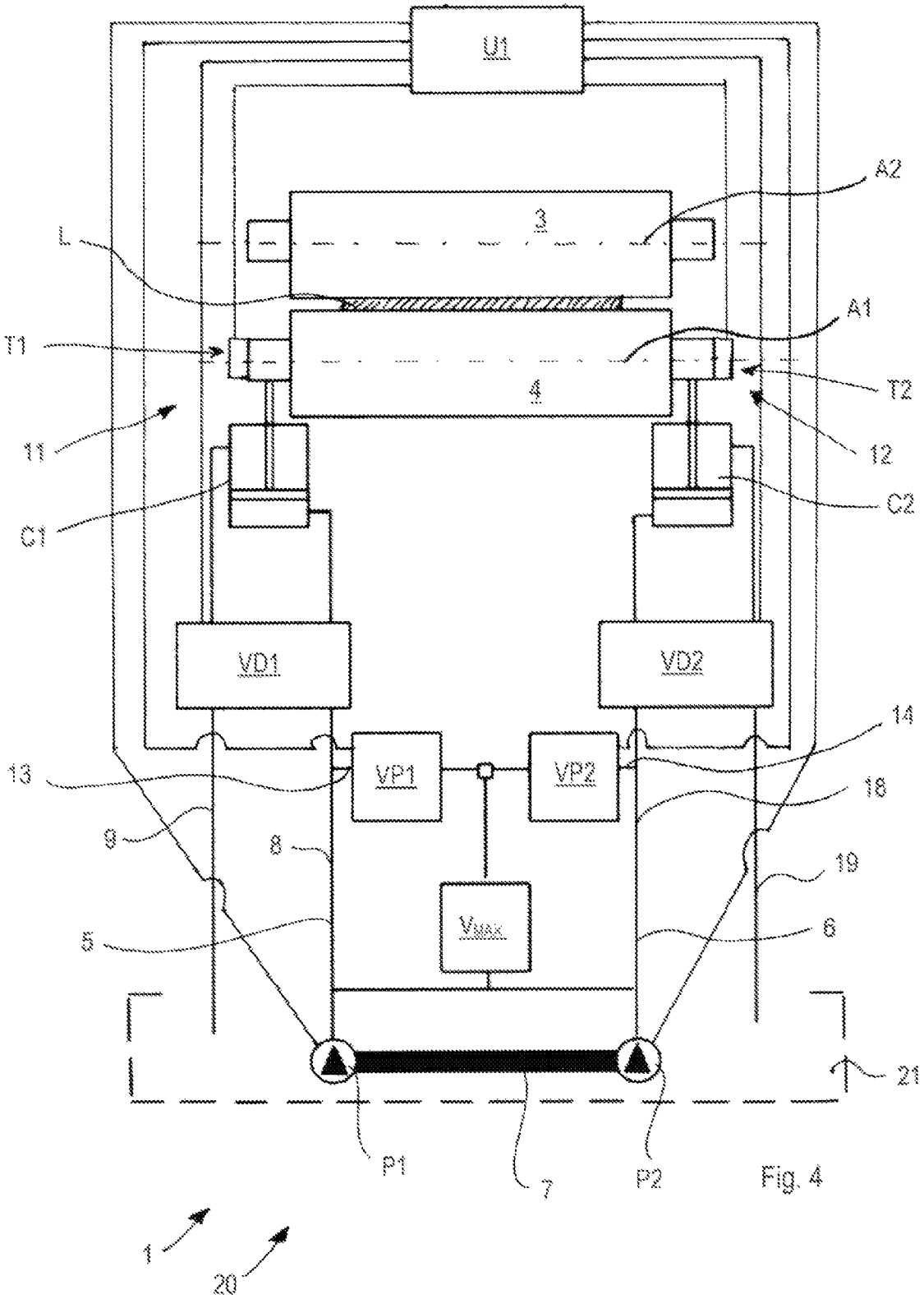

With reference to FIG. 4, at a first end 11 and at an opposite second end 12 of the movable roller 4, in the bending machine 1 or in the bending machine 10, a first hydraulic actuator C1 and a second hydraulic actuator C2 are provided respectively for moving the movable roller 4 towards or away from the dragging roller 3. The first C1 and second C2 hydraulic actuator are suppliable with an operating fluid, in particular oil, each by a respective pump and a dedicated hydraulic circuit. In particular, the first C1 and the second C2 hydraulic actuator are suppliable respectively with a first pump P1 and a second pump P2, through a first hydraulic circuit 5 and a second hydraulic circuit 6 that are independent of one another. The first pump P1 and the second pump P2 are operationally connected to one another. In particular, the first pump P1 and the second pump P2 are substantially similar to one another, of the same volumetric flowrate, and are mechanically connected to one another via a mechanical transmission shaft 7 as can be seen in schematized form in FIG. 4. The mechanical transmission shaft 7 that is common to the first P1 and to the second pump P2, is arranged for synchronizing the motion of the two aforesaid pumps at the same rotation speed, such as to supply the same oil volumetric flowrate values to the first C1 and second C2 hydraulic actuator. In other words, owing to this configuration and constructional condition, dispensing of identical quantities of oil to the first C1 and second C2 hydraulic actuator is ensured.

As can be seen in FIG. 4, the first hydraulic circuit 5 comprises a first delivery portion 8 that connects the first pump P1 to a first directional valve VD1. The first directional valve VD1 is connected by two connecting conduits to two respective fluid dynamic chambers of the first hydraulic actuator C1. The first directional valve VD1 acts to control the flow direction of the oil inside the first hydraulic actuator C1, such as to fill one chamber by emptying the other, depending on whether the first end 11 of the movable roller 4 has to be moved towards or away from the dragging roller 3.

The first hydraulic circuit 5 further comprises a first return portion 9 through which the oil that is evacuated from the first hydraulic actuator C1, passing through the first directional valve VD1, returns to a collecting and storage tank 21.

Similarly, the second hydraulic circuit 6 comprises a second delivery portion 18 that connects the second pump P2 to a second directional valve VD2, that has a function that is similar to what has been disclosed for the first directional valve VD1. The second directional valve VD2 is connected by two further connecting conduits to two respective further fluid dynamic chambers of the second hydraulic actuator C2. The second hydraulic circuit 6 comprises a second return portion 19 through which the oil that is evacuated from the second hydraulic actuator C2, passing through the second directional valve VD2, returns to the oil collecting and storage tank 21.

The control apparatus 20 comprises a first proportional flow valve VP1 and a second proportional valve VP2, associated respectively with the first hydraulic circuit 5 and with the second hydraulic circuit 6. The first proportional flow valve VP1 and the second proportional valve VP2 are connected according to a parallel configuration with respect to the first delivery portion 8 and to the second delivery portion 18. More precisely, the first proportional flow valve VP1 is placed along a first branch conduit 13 connected, in derivation, to the first delivery conduit 8 and extending as far as the tank 21.

Similarly, the second proportional valve VP2 is placed along a second branch conduit 14, connected, in derivation, to the second delivery conduit 18 and extending as far as the tank 21.

The first VP1 and second VP2 proportional valve, which are so positioned, are configured for being able to tap, i.e. draw, the oil respectively from the first 8 and second 18 delivery portion to reduce the volumetric flowrate of oil that flows respectively to the first C1 and second C2 hydraulic actuator. Substantially, unlike known prior art systems, in which the proportional valves are placed in series on the delivery portions of the oil to throttle the passage of the oil, in the control apparatus 20 according to the invention, the first VP1 and second VP2 proportional valve—which are placed in a "derivation" position i.e. "branched" position with respect to the delivery paths of the oil—are positioned for operating "parallel" to the "work" flow of the oil. As a result, the parallelism control of electronic type, obtained by acting on the first VP1 and second VP2 proportional valve, is an auxiliary or "additional" control to the inherent parallelism control already existing in the hydraulic circuit conformation of the control apparatus 20.

As shown in FIG. 4, a maximum pressure valve Vmax is also provided that is connected to the first 8 and second 18 delivery portion, the function of which is to deliver the circulating oil directly to the tank 21 if the pressure reaches a maximum set value, thus avoiding undesired damage to the bending machine.

Near the first end 11 and the second end 12 of the movable roller 4 a first T1 and a second T2 position transducer are respectively provided. The first T1 and the second T2 position transducer are arranged for detecting the positions of said first 11 and second 12 end.

The control apparatus 20 comprises an electronic control unit U1 to which the first VP1 and second VP2 proportional valve, the first VD1 and second VD2 directional valve, and the first T1 and second T2 position transducer are operationally connected. As will be seen in greater detail below, the first VP1 and second VP2 proportional valve are driven, in case of need, by the electronic control unit U1, on the basis of position signals produced by the first T1 and second T2 position transducer, such as to regulate the oil volumetric flowrate that advances to the first C1 and second C2 hydraulic actuator. The electronic control unit U1 is able to check the parallelism of the movable roller 4, or of each movable roller, of the bending machine 1 or 10 through position signals that are provided by the position transducers T1 and T2 and are compared by an analogue comparing unit, which in turn supplies instructions to a logical processing unit (PLC). The logical processing unit (PLC) comprises a suitably programmed microprocessor for automatically correcting possible parallelism errors by commanding the first VP1 and/or second VP2 proportional valve, or solenoid valves, for supplying the pressurized oil to the hydraulic actuators C1, C2 for the translation movement of the roller. The proportional valves or solenoid valves VP1, VP2, are activatable by respective driving solenoids by means of suitable electric pulses or signals.

The first T1 and second T2 position transducer can each comprise a linear potentiometric transducer that sends the position signals to a respective input of the control unit U1, which compares it with programmed reference data and then sends suitable instructions to the microprocessor, such as to intervene, if required, on the tilt of the movable roller 4.

Also the first pump P1 and the second pump P2 can be connected operationally to the electronic control unit U1, which controls all the various steps of a work cycle. In particular, the electronic control unit U1 commands the first VD1 and second VD2 directional valve in such a manner that the oil flow in the first C1 and in the second C2 hydraulic actuator is enabled in an advancement direction or in an opposite direction, depending on whether the movable roller 4 has to be moved towards or away from the dragging roller 3. In the case described, the first VD1 and second VD2 directional valve are driven by the electronic control unit U1 to lower or raise the movable roller 4.

During operation, in normal operating conditions, the first VP1 and second VP2 proportional valve are "normally closed", i.e. they are not traversed by a flow of oil, which oil thus advances undisturbed along respectively the first 8 and second 18 delivery portion with identical volumetric flowrate values both in the first 5 and in the second 6 hydraulic circuit, thus ensuring perfectly balanced driving of the first C1 and second C2 hydraulic actuator.

Essentially, owing to the particular structural configuration providing for a splitting of the circulation of the oil into two distinct and substantially identical hydraulic circuits, i.e. the first 5 and second 6 hydraulic circuit, a first control level, of hydraulic type, of the parallelism is defined that guarantees, with a satisfactory degree of precision, the parallelism of the movable roller 4, more precisely, the parallelism of a first longitudinal axis A1 of the movable roller 4 with respect to a second longitudinal axis A2 of the dragging roller 3, during raising or lowering, also in a non-centered loading operating situation, i.e. with a load acting near the first 11 or the second 12 end.

During operation, in normal operating conditions, the piece of sheet metal L is appropriately bent by the interaction with the movable roller 4 and with the dragging roller 3, without the first VP1 and second VP2 proportional valve intervening, which remain "normally closed".

In other words, the parallelism condition is maintained through the effect of the hydraulic control level that derives from the particular hydraulic supply that is split and balanced in relation to the two hydraulic actuators C1 and C2. If factors intervene that have a strong influence on the parallelism condition, for example a noticeable decentring of the piece of sheet metal L with respect to the median zone of the rollers, or an irregularity of the thickness of the piece of sheet metal L or something else and the parallelism condition can no longer be assured by relying only on the duplicated hydraulic conformation disclosed above, the control unit U1 intervenes to open the first VP1 and/or second VP2 proportional valve. A second control level of electronic type thus intervenes, which is servo-assisted by the first hydraulic control level disclosed above, but is independent thereof. For example, if the first hydraulic actuator C1 advances faster upwards, the first proportional flow valve VP1 is opened (and not closed as would occur in a prior-art apparatus), to enable a calibrated passage of the derived oil, i.e. of the oil tapped, i.e. drawn, parallely from the first delivery portion 8, to the tank 21. Thus part of the oil, instead of continuing to advance to the first hydraulic actuator C1, is discharged freely (and thus at the working pressure of the piece of sheet metal L and not at maximum pressure as would occur in the prior-art apparatus) to the tank 21. This means that a smaller amount of oil reaches the first hydraulic actuator C1, thus slowing the first hydraulic actuator C1 and adapting the position and advancement speed thereof to those of the second hydraulic actuator C2. At this point, the first C1 and second C2 hydraulic actuator can continue advancement perfectly synchronized with one another. The control of the parallelism of the movable roller 4 can be carried out indifferently both during the ascent and the descent movement of the movable roller 4.

Owing to the particular configuration of the control apparatus 20, the first VP1 and second VP2 proportional valves are thus not fatigued and are driven only when strictly necessary, i.e. with reduced frequency compared with what occurs in the prior art, as the parallelism is maintained in most of the operating circumstances by the hydraulic control level inherent to the hydraulic structural conformation of the control apparatus 20. Both the proportional valves VP1, VP2 and the first P1 and second pump P2 and all the other components of the apparatus operate subject to a pressure that is the one requested by the working of the piece of sheet metal L, and never at a higher pressure, this resulting in an extension to the working life of the hydraulic componentry of the bending machine. It is thus clear how the parallelism condition of the movable roller 4, owing to the control apparatus 20, can be ensured without the need to depend exclusively on the proportional valves VP1, VP2; i.e. in the event of a fault of the proportional valves VP1, VP2, the parallelism condition, in relation to non-exceptional operating conditions, is ensured by the hydraulic structural configuration of the apparatus 20. In other words, if the electronic componentry is faulty, the control apparatus 20 continues to maintain the movable roller 4 parallel to itself or to the dragging roller 3, up to a new load near the maximum permissible value, enabling the bending machine 1 to be used continuously.

The parallelism obtained "hydraulically" proves to be tougher, more reliable, safer and simpler to maintain than what is obtainable by resorting only to electronics, as occurs in the prior art. The reduction of the probabilities of a fault in the electronic componentry obtained with the control apparatus 20 according to the invention enables the need to resort to interventions by expensive specialized personnel for repairing electronic faults to be significantly reduced or even eliminated. In all cases, even in the event of a fault to an electronic component, the bending machine, owing to the control apparatus 20, can continue to be used without causing machine downtime, in normal operating circumstances in which exceptional load conditions do not occur or in which no commanded variation is required of the tilt of the first longitudinal axis A1 with respect to the second longitudinal axis A2, for example for conical bending of the sheet metal, or for bending section bars, made on the outside of the rollers, on apposite shaping portions protruding from the latter.

In conclusion, the control apparatus 20 according to the invention, including a first control level of hydraulic type, and a second control level of electronic type, make the bending machine 1 or 10 more reliable and efficient, drastically reducing machine downtime risks.

The invention claimed is:

1. Apparatus for the electrohydraulic control of the parallelism of a roller of a bending machine for processing metal pieces, comprising:

pump means for feeding with an operating fluid first actuating means and second actuating means arranged for moving respectively a first end and a second end of said roller;

position transducer means operatively connected to an electronic control unit and suitable for detecting the positions of said first and second end;

first and second proportional valve means that are operatively controllable by said electronic control unit to adjust the flow of said operating fluid into said first and second actuating means according to signals of said position transducer means wherein:

said pump means comprises a first pump and a second pump operatively connected to each other, which are arranged for supplying in a dedicated manner said first and second actuating means respectively by means of a first and a second hydraulic circuit that are independent of one another, wherein said first pump and said second pump are mechanically connected to one another with a common mechanical transmission shaft, arranged for synchronizing the motion of said first pump and of said second pump at the same rotation speed such as to provide the same operating fluid volumetric flowrate values to said first and second actuating means;

said first and second proportional valve means being located, according to a parallel configuration, along a first and a second ducts that are connected in a branched manner to a first and second delivery portion of said first and second hydraulic circuits respectively, said first and second proportional valve means being so configured as to be able to draw operating fluid from said first and second delivery portion to reduce the volumetric flowrate thereof to said first and/or second actuating means.

2. Apparatus according to claim 1, further comprising first and second directional valve means provided in said first and second circuit respectively, in order to adjust the flow direction of said operating fluid with respect to said first and second actuating means.

3. Apparatus according to claim 1, wherein said first and second branched ducts extend in such a manner as to make the operating fluid coming from said first and second proportional valve flow into a tank supplying said first and second hydraulic circuit.

4. Apparatus according to claim 3, wherein said first pump and said second pump are connected to a maximum pressure valve that discharges the operating fluid inside said tank when a set maximum pressure value is reached.

5. Bending machine for processing metal products such as sheet metals or section bars, comprising two or more bending rollers and an apparatus for controlling parallelism according to claim 1 arranged for controlling the parallelism of at least one of said two or more bending rollers.

* * * * *